US009814990B2

(12) United States Patent
Lacy et al.

(10) Patent No.: US 9,814,990 B2
(45) Date of Patent: Nov. 14, 2017

(54) MULTIUSER AMUSEMENT ROCKING DEVICE

(71) Applicant: Plow & Hearth, LLC., Madison, VA (US)

(72) Inventors: Amanda Lacy, Portland, ME (US); Beverly Fries, Barboursville, VA (US); Ting Xu, Richmond, VA (US); David Yakos, Bozeman, MT (US)

(73) Assignee: Plow & Hearth, LLC, Madison, VA (US)

( * ) Notice: Subject to any disclaimer, the term of this patent is extended or adjusted under 35 U.S.C. 154(b) by 0 days.

(21) Appl. No.: 15/250,389

(22) Filed: Aug. 29, 2016

(65) Prior Publication Data

US 2017/0266570 A1 Sep. 21, 2017

Related U.S. Application Data

(60) Provisional application No. 62/308,398, filed on Mar. 15, 2016.

(51) Int. Cl.
*A63G 23/00* (2006.01)
*A63B 26/00* (2006.01)

(52) U.S. Cl.
CPC ..... *A63G 23/00* (2013.01)

(58) Field of Classification Search
CPC ..... A63G 23/00; A63B 26/00; A63B 26/003; A63B 21/0004; A63B 22/16; A63B 22/18; A47D 15/00; A47D 15/008; A47C 21/08
USPC .... 472/108, 114, 115, 135; 5/111, 424, 425; 135/126
See application file for complete search history.

(56) References Cited

U.S. PATENT DOCUMENTS 2,600,556 A * 6/1952 Malm ..... A47D 15/008 5/424
2,615,495 A * 10/1952 Hilliker ..... A63G 23/00 280/18.1
3,960,161 A * 6/1976 Norman ..... E04H 15/18 135/126
5,860,175 A * 1/1999 Saiki ..... A45F 3/26 5/111
5,898,964 A * 5/1999 Stanley ..... A47C 21/08 5/425

OTHER PUBLICATIONS

Shallow Swing Potato Chip Chair [online], [retrieved Sep. 25, 2015]. Retrieved from Internet <URL: http://www.shallowswing.de/>; 6 color sheets.

* cited by examiner

*Primary Examiner* — Kien Nguyen
(74) *Attorney, Agent, or Firm* — Banner & Witcoff, Ltd.

(57) ABSTRACT

An outdoor amusement rocking device having a frame and a support member that together form a curvature saddle-shaped play structure. The amusement device includes a hyperbole paraboloid frame structure defining an interior area and a resilient support sheet material disposed in the interior area of the frame and attached to the frame.

20 Claims, 16 Drawing Sheets

MULTIUSER AMUSEMENT ROCKING DEVICE

CROSS-REFERENCE TO RELATED APPLICATIONS

The present application claims priority to U.S. Provisional Application 62/308,398, filed Mar. 15, 2016, the disclosure of which is incorporated herein by reference.

FIELD OF INVENTION

The field of invention relates generally to amusement devices, and more specifically, to a hyperbolic paraboloid saddle-shaped play structure that can be used to create a back and forth or up and down rocking or pivotal motion by one or more users.

BACKGROUND

Playground seesaws are typically designed with a lever centered on a fulcrum having a handle on each end. The users sit on each end of the lever and take turns pushing their feet against the ground to lift their side in the air to allow up and down movement. The up and down movement starts when one user pushes against the ground to lift their side into the air causing the other user, whose side was in the air, to descend until his/her feet hit the ground. The movement generally does not start again until the user whose feet are on the ground pushes against the ground to lift his side. There exists a need for a playground device that allows users to create a more fluid and versatile rocking movement.

SUMMARY

Aspects of the present disclosure relate to an outdoor amusement rocking device having a frame and a supporting member that together form a curvature saddle-shaped play structure. In one aspect, an amusement device includes a hyperbole paraboloid frame structure defining an interior area and a resilient support member disposed in the interior area of the frame and removably attached to the frame. In one aspect, the hyperbole paraboloid frame structure may comprise two member halves being pivotally attached together. In another aspect, the frame structure may include at least one hinge assembly having a first hinge body and a second hinge body. In yet another aspect, at least one of the first hinge body and second hinge body may include a locking device.

BRIEF DESCRIPTION OF THE DRAWINGS

The present disclosure is pointed out with particularity in the appended claims. Features of the disclosure will become more apparent upon a review of this disclosure in its entirety, including the drawing figures provided herewith.

Some features herein are illustrated by way of example, and not by way of limitation, in the figures of the accompanying drawings, in which like reference numerals refer to similar elements, and wherein.

DETAILED DESCRIPTION

Figure 1:
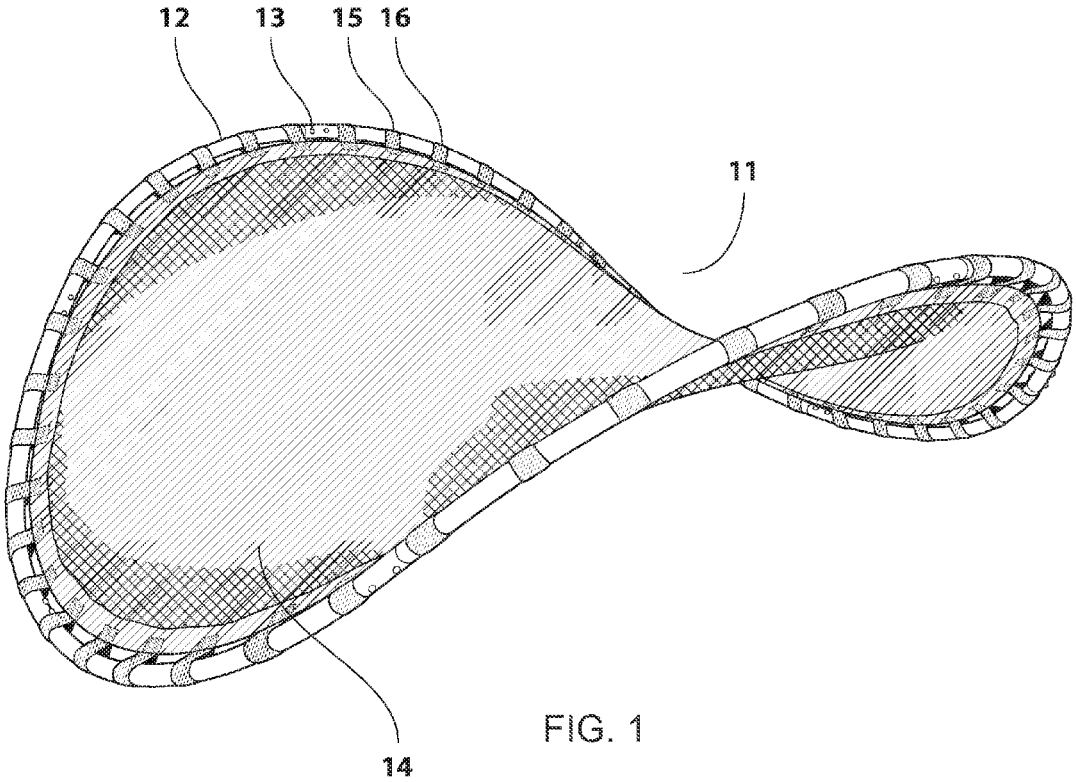
FIG. 1 illustrates a perspective view of an amusement rocking device in accordance with the various teachings of the present disclosure.
Figure 2A:
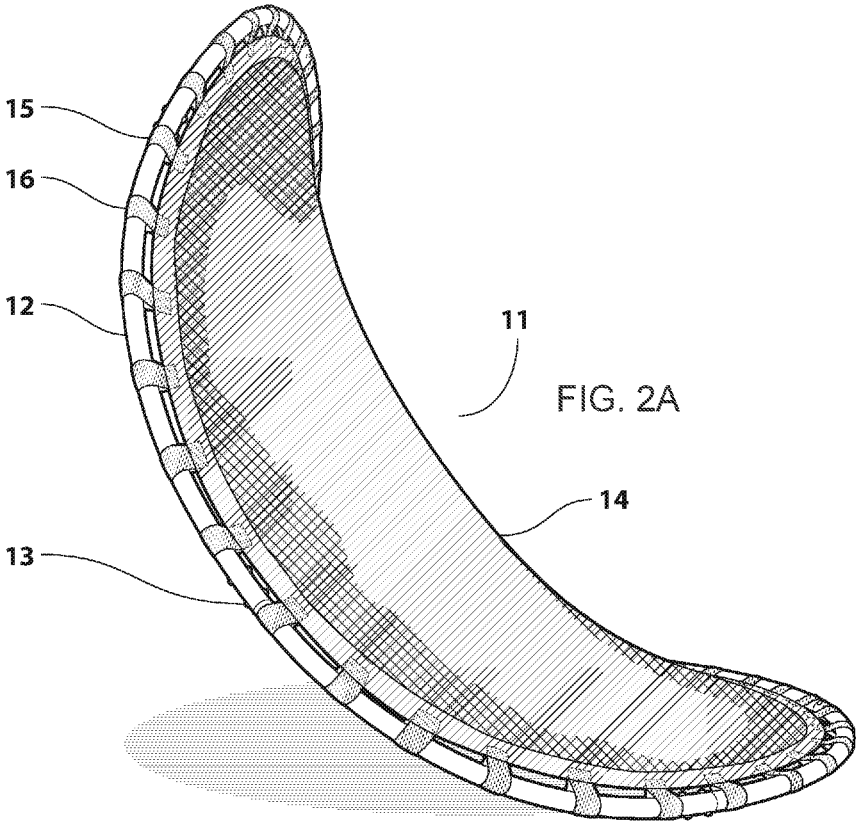
FIG. 2A-2B illustrates side views of the amusement device of FIG. 1.
Figure 2B:
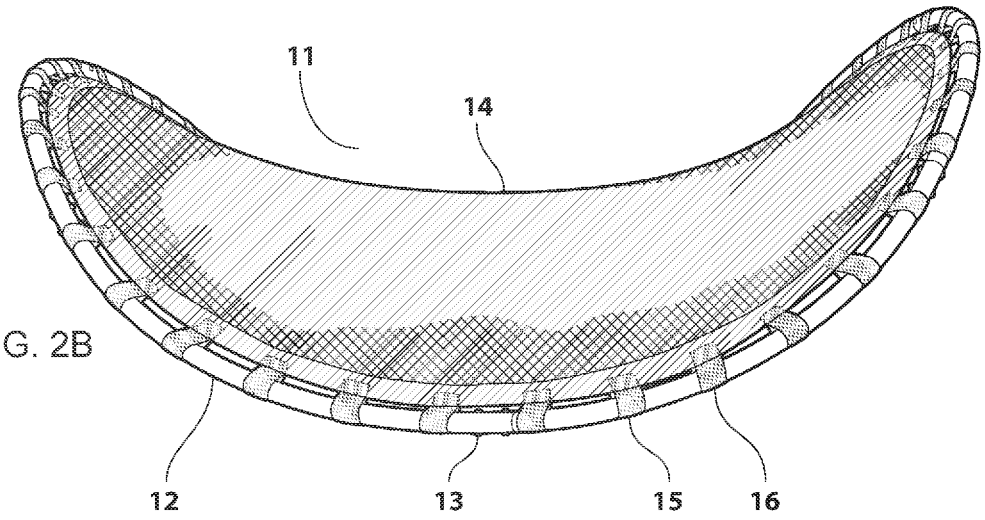
Figure 3A:
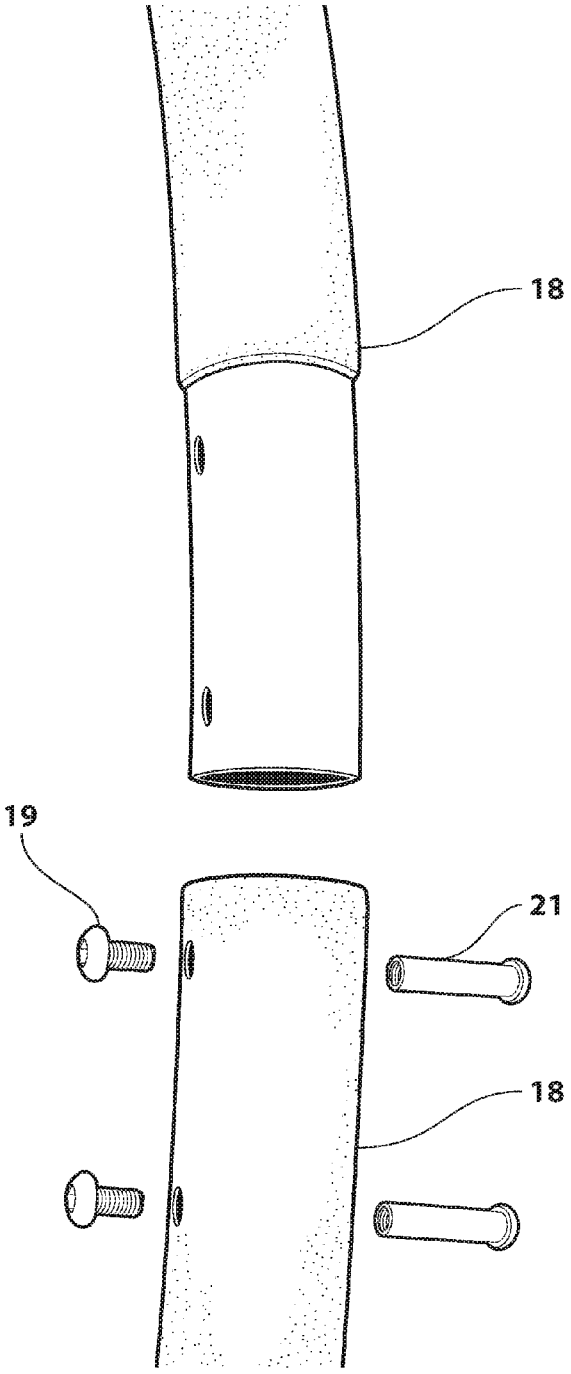
FIG. 3A illustrates the connection of curved tubes which form the frame of the amusement device.
Figure 3B:
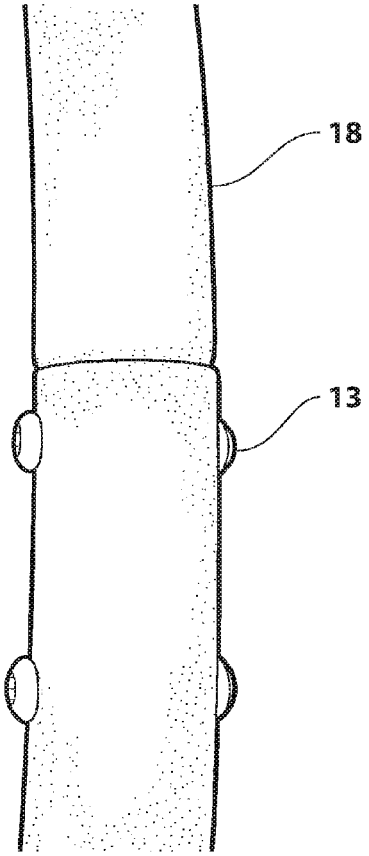
FIG. 3B illustrates the steel tubes which form the frame of the amusement device.

In the following description of various illustrative embodiments, reference is made to the accompanying drawings, which form a part hereof, and in which is shown, by way of illustration, various embodiments in which aspects of the disclosure may be practiced. It is to be understood that other embodiments may be utilized, and structural and functional modifications may be made, without departing from the scope of the present disclosure.

As illustrated in FIGS. 1, 2A-B and FIG. 11, in accordance with various constructions, is a portable amusement rocking device 11 ("amusement device") for placement in a suitable open area, such as a lawn, park, playground or the similar area. Among other features, the amusement device 11 includes a hyperbole paraboloid saddle shape frame 12, a support member/sheet 14, polyester fabric sleeves 15 and elastic fabric sleeves 16.

As illustrated in FIGS. 3A, 3B, 6-7 in accordance at least one construction, tubes 18 that are assembled and connected together to form the frame 12 of the amusement device 11. In one construction shown in FIG. 9, the frame 12 is comprised of eight curved tubes 18. The tubes 18 can be made of a molded or casted construction of high strength materials, such as aluminum or steel or high strength plastic or composite material. In one construction, each tube 18 measures 44.5 inches in length with a radius circumference of 33 inches. However, embodiments are not limited to eight tubes 18 or the specific measurements described herein. Other embodiments could comprise two or more tubes 18, and the tubes 18 could range in other lengths and radii of circumference. In one construction, each tube 18 has a male end on one side and a female end on the opposing side. There are two alignment construction holes are located each tube on the male end and the female end. For assembly, the female side of one tube slidingly engages on to the male side of another tube. The holes on either side of each tube align together for construction. As shown on FIG. 3A, to form a mechanically strong bond, a mating thread screw 19 is placed into one side of the aperture and the barrel bolt 21 is matingly threaded to receive the screw 19 from the other side of the aperture. The two components screw 19 and bolt 21 form fastener screws.

Figure 6:
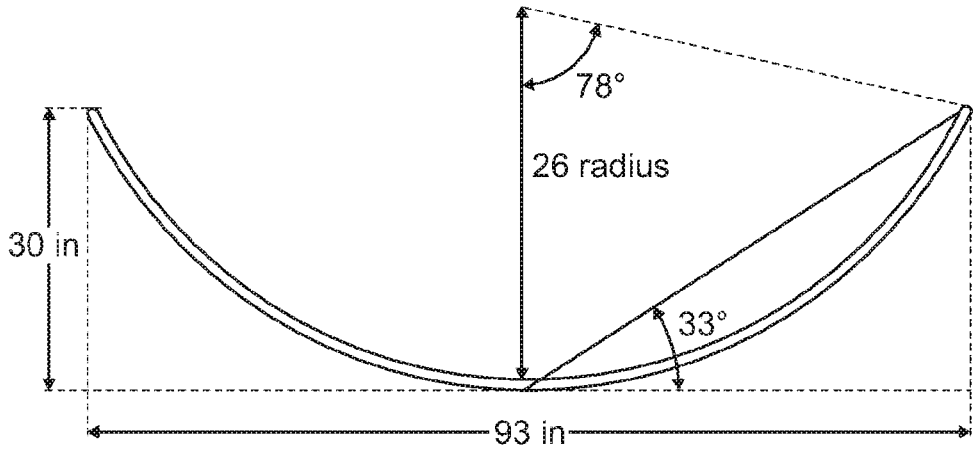
FIG. 6 is a schematic diagram of a tube construction according to the teachings of the present disclosure.
Figure 7:
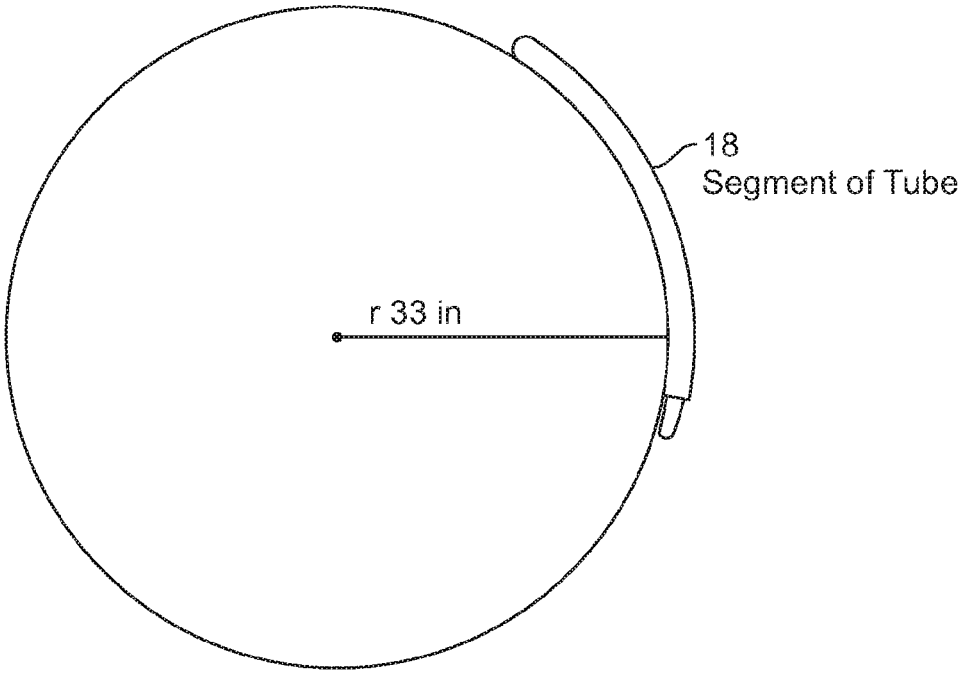
FIG. 7 is a schematic diagram of a tube construction according to the teachings of the present disclosure.

The fastener screws 13 are joined together inside the tube. However, construction is not limited therein and may comprise other fastening or locking devices to connect the tubes 18 that fall within the spirit and scope of the principles of this disclosure. As shown in FIG. 6, four tubes form to make one half of the frame, the angle of each half measuring 33 degrees. The one half of the frame length can measure 93 inches and the height can be 30 inches. However, embodiments are not limited to the measurements described herein. In other embodiments, the tubes 18 forming the halves of the frame could be of any number of dimensions that fall within the spirit and scope of the principles of this disclosure to form a saddle-shape structure of the amusement device 11. The height of the curved ends and the arc of the base setting on ground (see FIG. 6) are designed to allow amusement device 11 to rock or pivot back and forth when the two sides are connected, the frame 12 forms the shape of a hyperbole paraboloid saddle shape figure.

Figure 4:
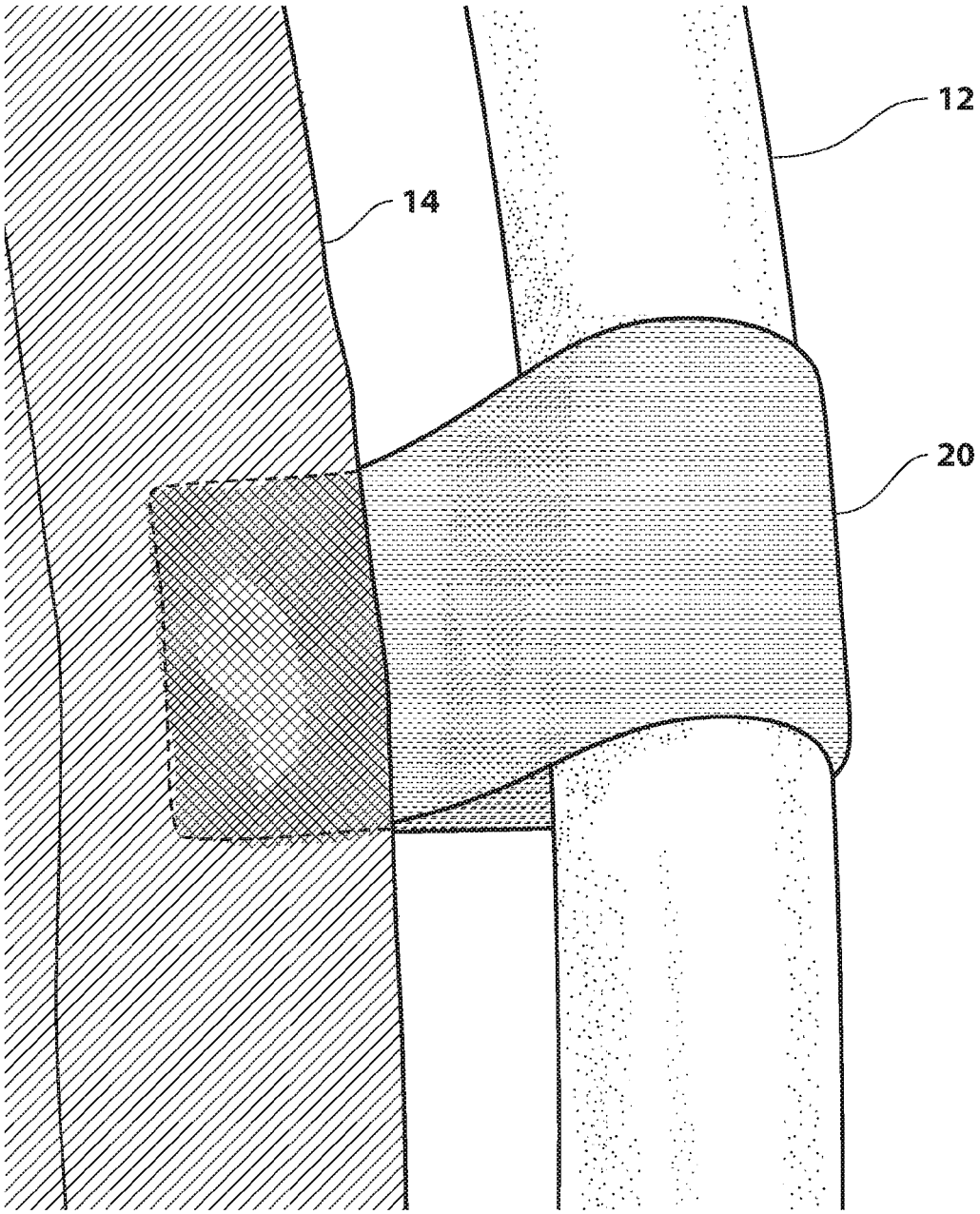
FIG. 4 illustrates the fabric sleeves which connected the support member to the frame.

As illustrated in FIG. 4, in accordance with embodiments, the support member 14 is removably attached to the frame with fabric sleeves 20 (polyester fabric sleeves 15 and elastic fabric sleeves 16). The supporting member 14 may be made of a stretchable elastic woven fiber or plurality of fibers or a sheet resilient material. The fabric sleeves 20 are sewn into the support member 14 at the edge of the support member 14. The edge of the support member 14 is reinforced with double layer of material and the ends of either side of the fabric sleeves 20 are sewn in between the two layers of material. However, embodiments are not limited to sewn in fabric sleeves 20 described herein and may encompass other methods of affixing the fabric sleeves 20 to the support member 14 that fall within the spirit and scope of the principles of this disclosure. The layer of material at the edge of the support member 14 can be applied with phosphorescent material to allow the edging of the support member 14 to "glow" in the dark. The fabric sleeves 15 are made of polyester material and the fabric sleeves 16 are made of elastic material. In one construction, there are twenty-four polyester fabric sleeves 15 and twenty-four elastic fabric sleeves 16. More or less sleeves could be implemented on the device 11. In one construction, the polyester fabric sleeve 15 is sewn into the support member 14 alternating with the elastic fabric sleeve 16 so that every other fabric sleeve is a polyester fabric sleeve 15. The polyester fabric sleeves 15 provide additional strength and keep the support member 14 from over-stretching when the amusement device 11 is supporting the mass/weight of users in-static use or in dynamic movement of the user.

It should be noted that the polyester fabric sleeves 15 would be considered non-resilient. The elastic fabric sleeves 16 would be considered to have a resilient material characteristic. In one case, the ratio of elasticity of the sleeves 16 to the elasticity of sleeve 15 is greater than 1.0. More particularity, the noted ratio may be 1.3, 1.5, 1.6 to 2.0. (Elasticity16/Elasticity15). That is, the modulus of elasticity of the sleeves 16 is greater than modulus of elasticity of the sleeve 15. In one advantage, the elastic fabric sleeves (elastic belt loop) 16 makes it possible to assemble and disassemble the frame 12 easier as needed. In one construction, a phosphorescent material can be applied to the fabric sleeves 15, 16, and 20 to allow the fabric sleeves to be luminescent in the dark. The supporting member 14 is made of woven fiber construction. However, embodiments are not limited to fabric material or the combination of fabric sleeves 15, 16 described herein and may encompass other resilient and non-resilient materials that fall within the spirit and scope of the principles of this disclosure.

Figure 5A:
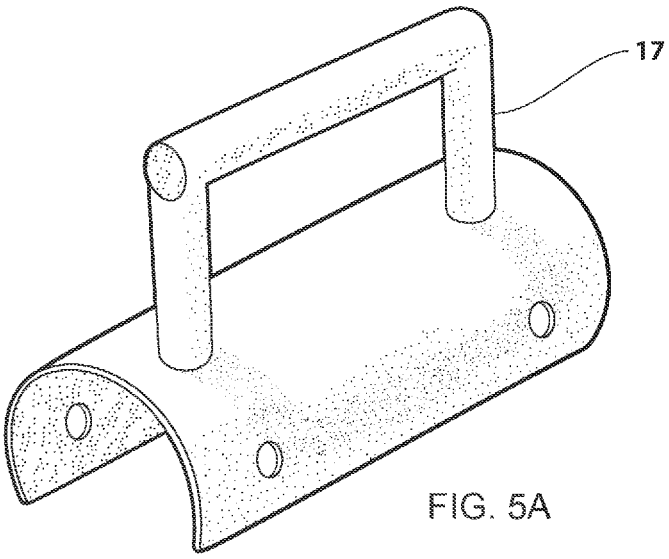
FIG. 5A illustrates the handle that can be mounted to the frame of the amusement device.
Figure 5B:
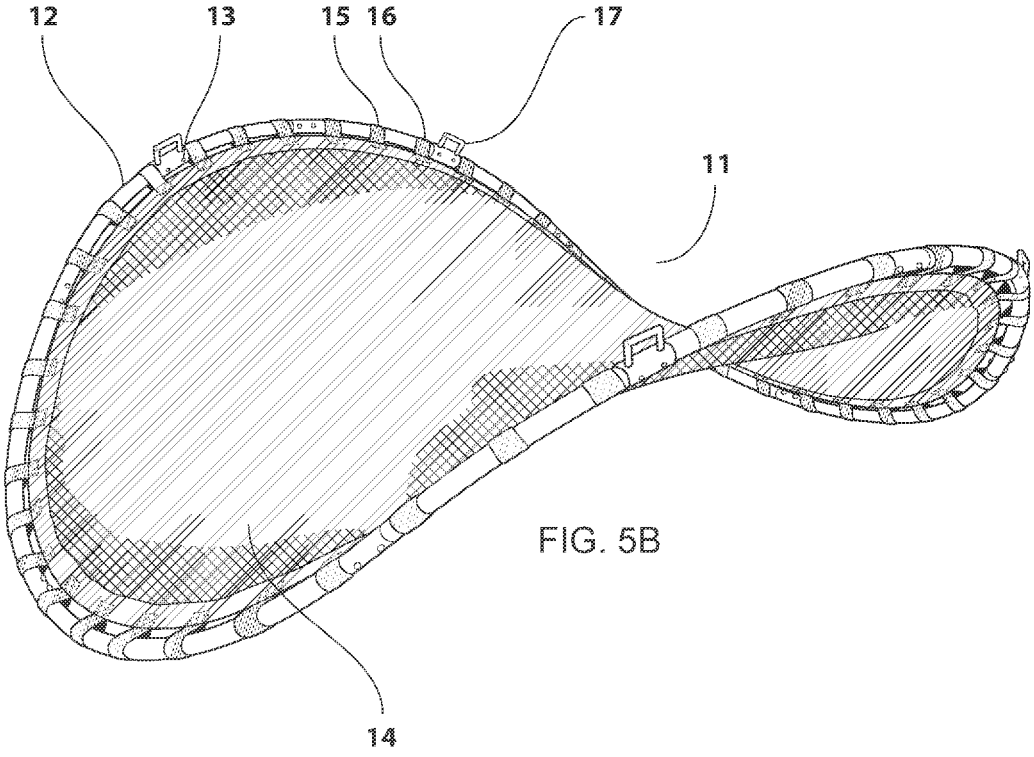
FIG. 5B illustrates the handles attached to various location on the amusement device frame.

As illustrated in FIGS. 5 and 6, in accordance with one construction, the handle 17 is removably attached to the frame 12. The handle 17 includes a horizontal bar for hand gripping and two integral supporting members (e.g., bars or tubes) perpendicular to the bar that permanently rest on circular cross-section base. The base of the handle 17 has four mounting holes, two mounting holes on one side of the frame and two mounting holes on the other side. The base of the handle 17 is circular to snugly fit around the frame 12. The holes in the handle 17 align with corresponding holes in the frame 12. The handle 17 is removably attached to the frame 12 with fastener screws 13 that engage into the frame holes. In one construction, handles 17 padded with foam material to provide ease of handling in-use of the device 11. In another embodiment of the amusement device 200 in FIG. 21, fabric handles 230 are disposed at strategic locations on the support member 14. The handles 230 can be made of a Nylon webbing or other material of sufficient strength.

In one operation of the amusement device 12, at least one user can mount on either end of the support member 14. The users positioned on opposite ends of the amusement device 11 can rock or pivot up and down or from side to side. Users can sit stationary from each end of the amusement device 11. Users can stand in the center of the amusement device 11 and rock or pivot from side to side. Users can sit, stand or lay on the amusement device to create variety of rocking or pivotal motions at varying intensities and speeds or remain stationary. (See FIG. 11) The handles 17 can be used to grip the frame for additional support and stabilization when the amusement device 11 is in motion.

Figure 8:
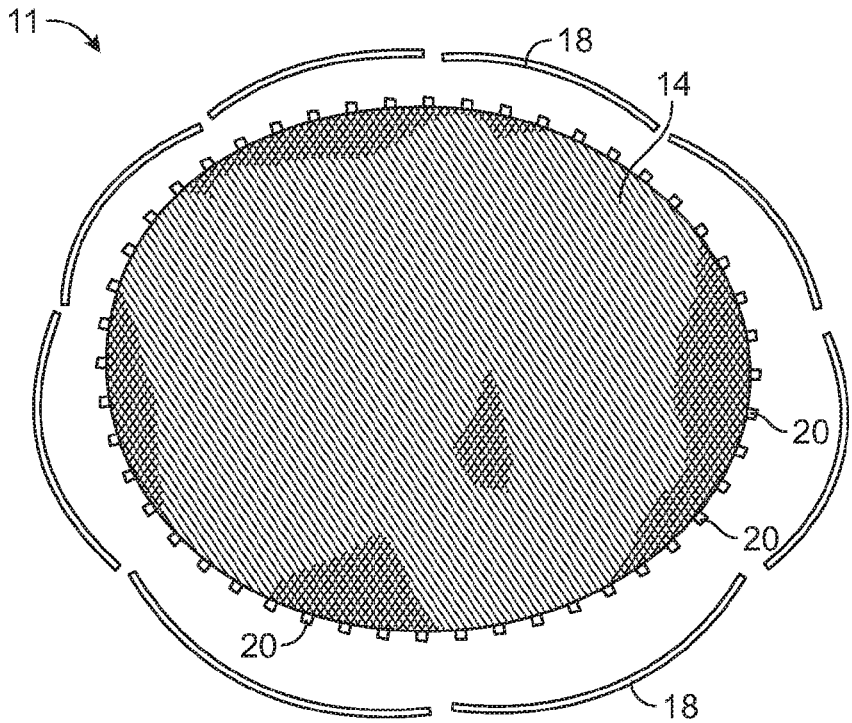
FIG. 8 illustrates a pre-assembled exploded configuration of the amusement device.
Figure 9:
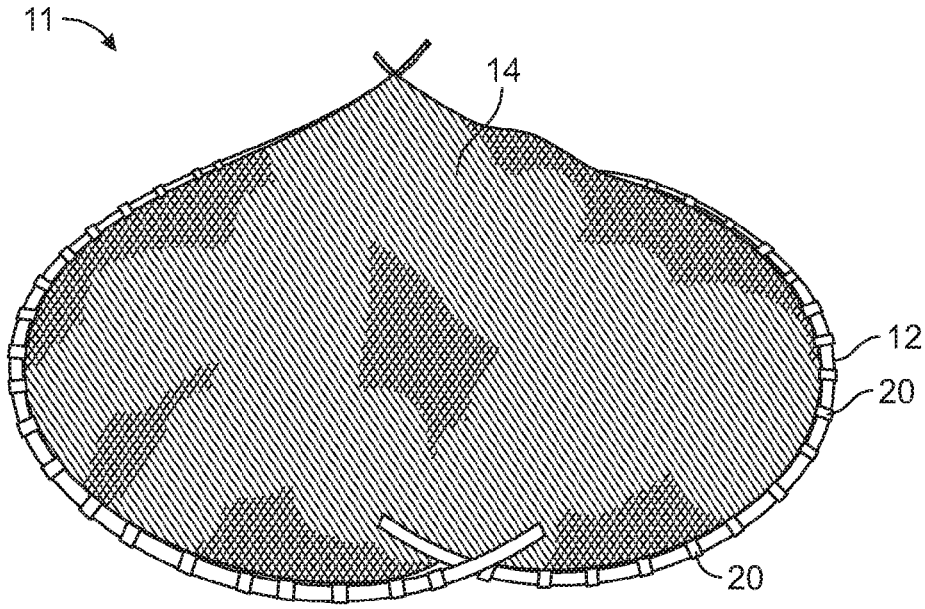
FIG. 9-10 illustrates the amusement device in a different state during assembling and construction.
Figure 10:
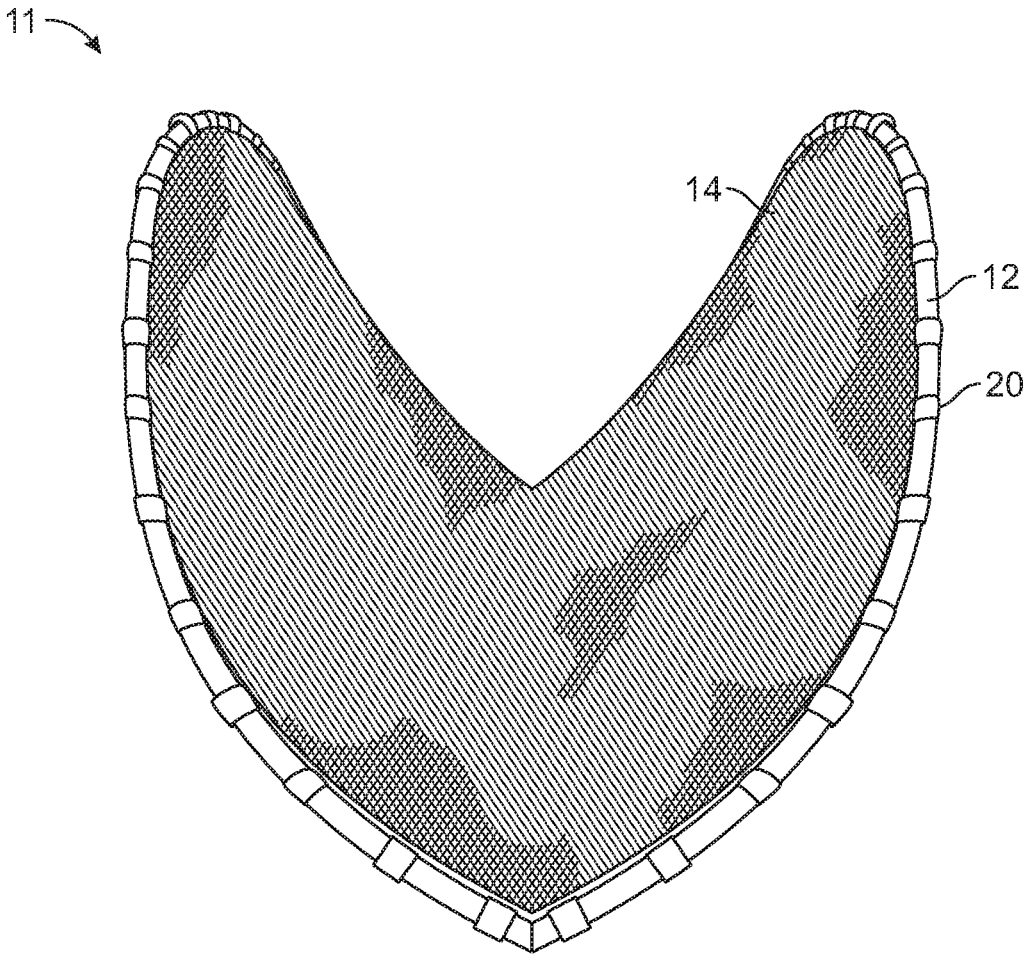
Figure 11:
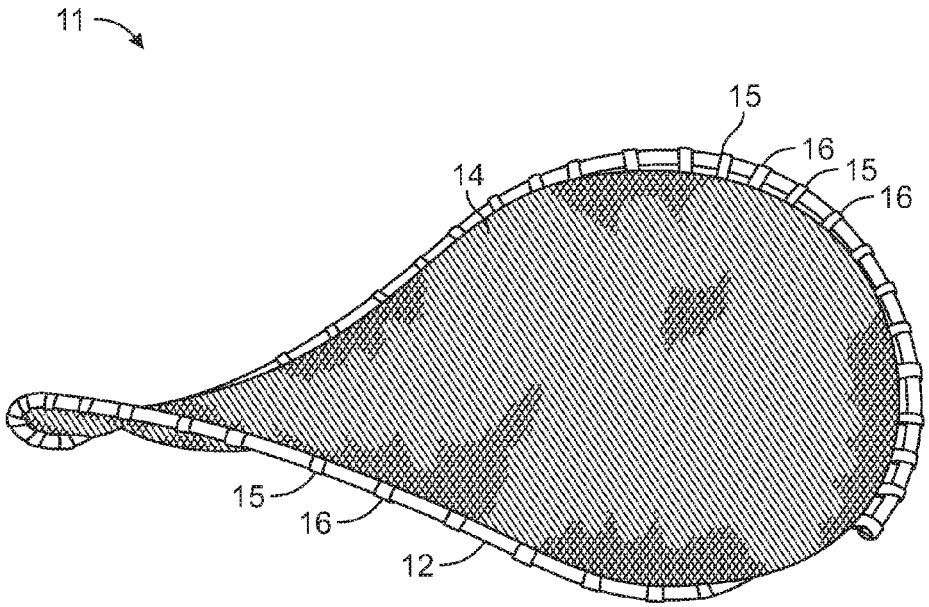
FIG. 11 illustrates one in-use function of the amusement device.

For assembly as shown in FIG. 8, tube 18 pieces are arranged in a general unassembled circle. Male/female ends should be placed next to each other. Next, the support member 14 is placed in the interior area formed by the circular form. Next, the screws are inserted in the tubes 18 to assemble each half of the device 11 separately. As shown in FIG. 9, once the two halves of the device 11 have been assembled, two halves can be placed next to each other. Next, a person on each side and at each end of the frame 12 can position the bottom pieces of each half so that the ends are just touching. (See FIG. 10) Once the ends are touching, that the male/female ends of tubes 18 can be push together as the two sides are coming together and are fastened. (See FIG. 11).

FIGS. 13-19 illustrate an alternative rocking amusement device 100 similar to the construction of rocking amusement device 11 of FIG. 1, except that amusement device 100 includes locking hinge assembly 110 connecting the two halves of the device 100 together. The halves of device 100 could comprise one single tube 18 or several interconnected tubes 18, and the tubes 18 could range in various lengths and radii of circumference. In other constructions, the tubes 18 forming the halves of the frame could be of any number of dimensions that fall within the spirit and scope of the principles of this disclosure to form a saddle-shape structure of the amusement device 11. The height of the curved ends and the arc of the base setting on ground are designed to allow amusement device 100 to rock or pivot back and forth when the two sides are connected, the frame forms the shape of a hyperbole paraboloid saddle shape figure.

Figure 13:
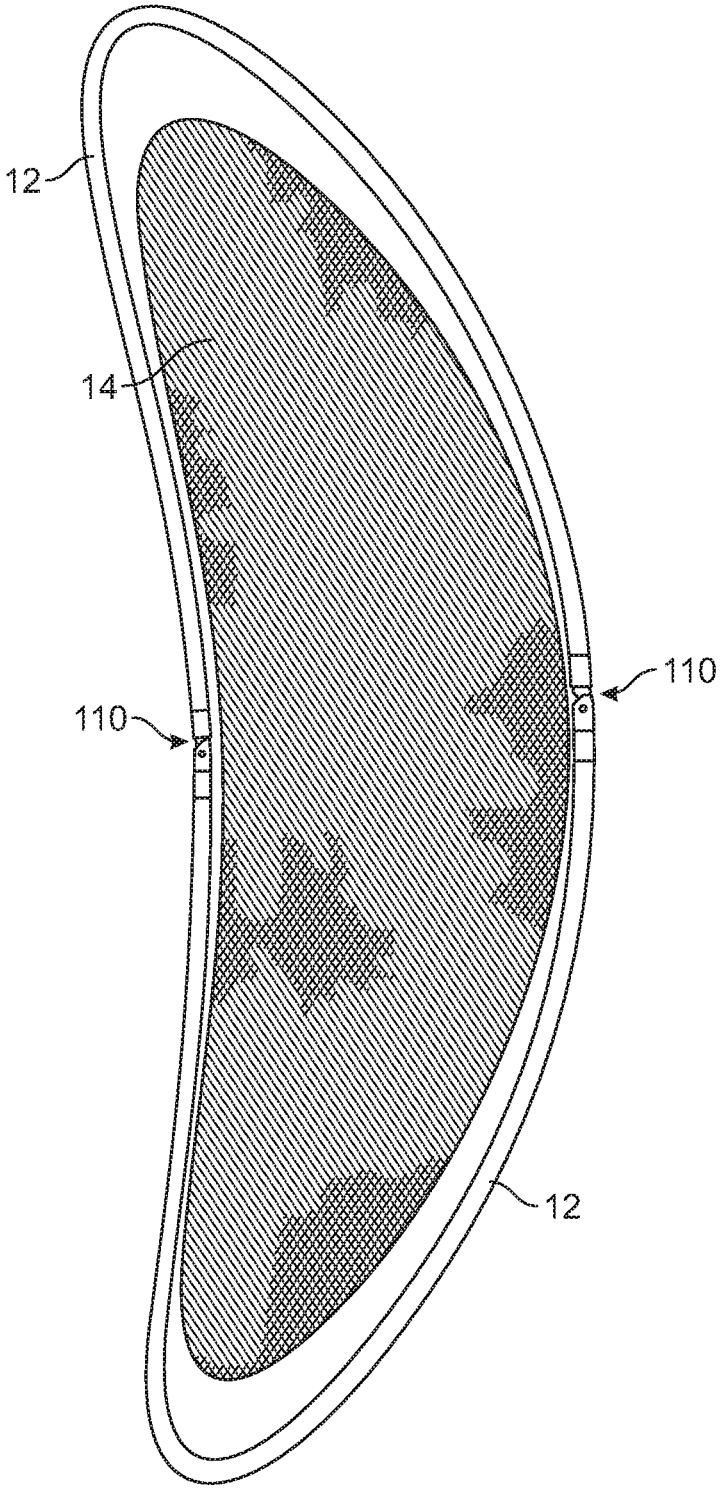
FIG. 13 illustrates an alternative schematic construction of an amusement device in an open position according to the teachings of the present disclosure.
Figure 14:
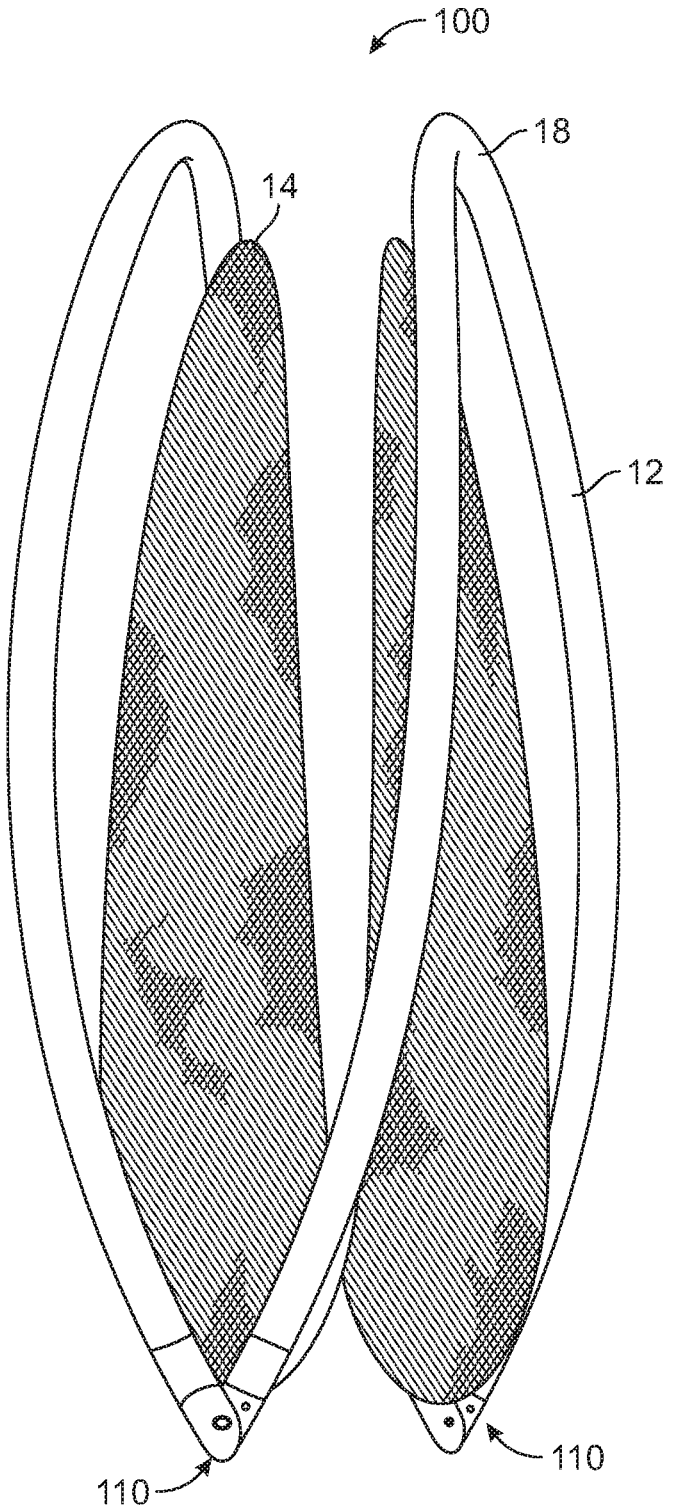
FIG. 14 illustrates the alternative schematic construction of the amusement device of FIG. 13 in a folded position according to the teachings of the present disclosure.

As best shown in FIG. 14, hinge assembly 110 enables the amusement device 100 to be folded and collapsed into in an arrangement similar to a clam shell design such that the two halves of the device 100 can be rotated towards each other or away from each other. This collapsed arrangement enables the amusement device 100 to be stored in a compact manner and can be easily transported to a designated location for use, such as an outdoor playground or indoor area. As shown in FIG. 13, amusement device 100 two halves can be fully opened to a locked position for use.

Figure 15:
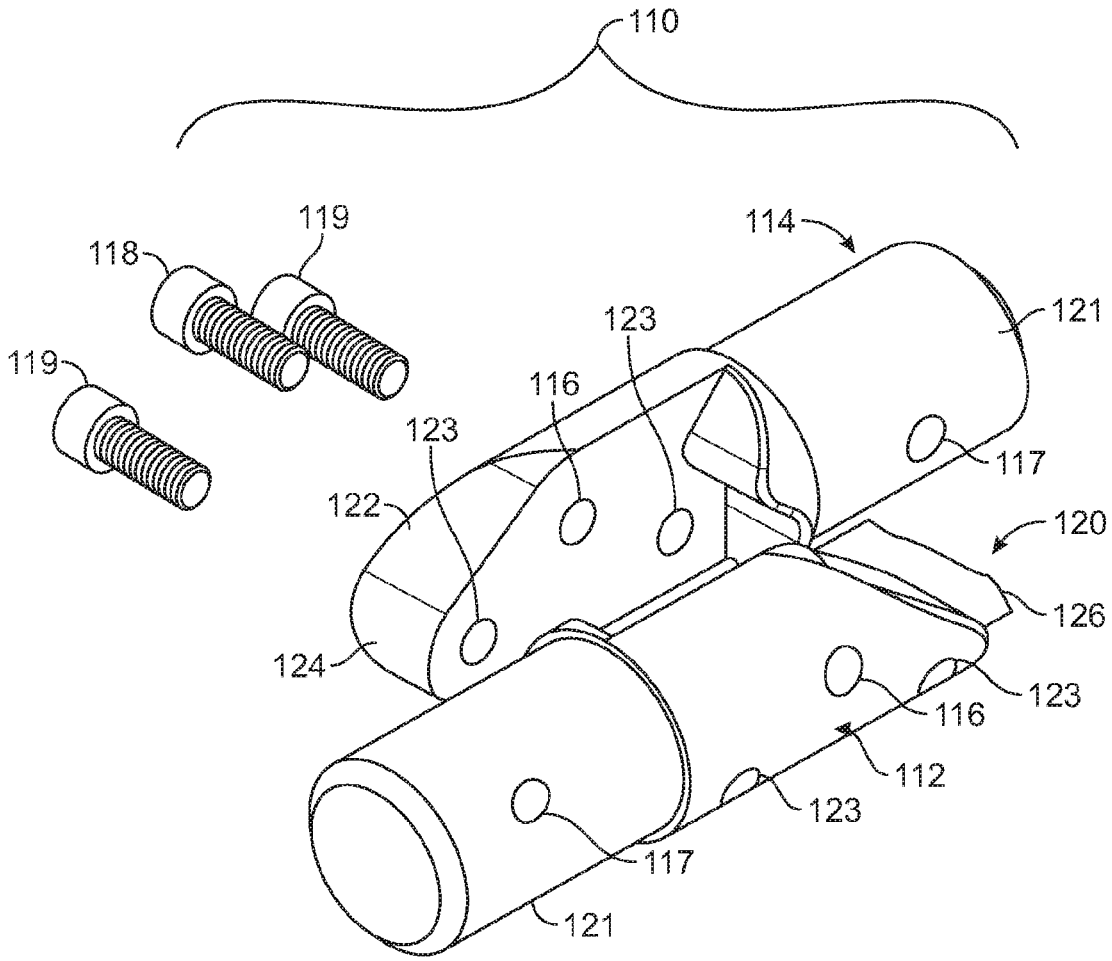
FIG. 15 illustrates an exploded assembly view of a pivotally hinge assembly according to the teachings of the present disclosure
Figure 16:
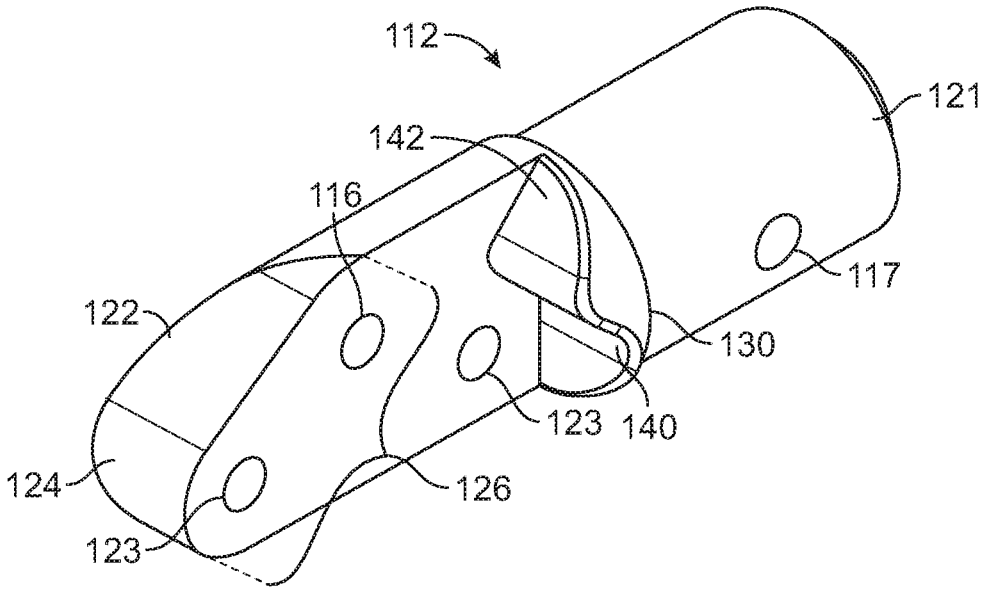
FIGS. 16 and 17 illustrate mating hinge components of the hinge assembly shown in isolation.
Figure 17:
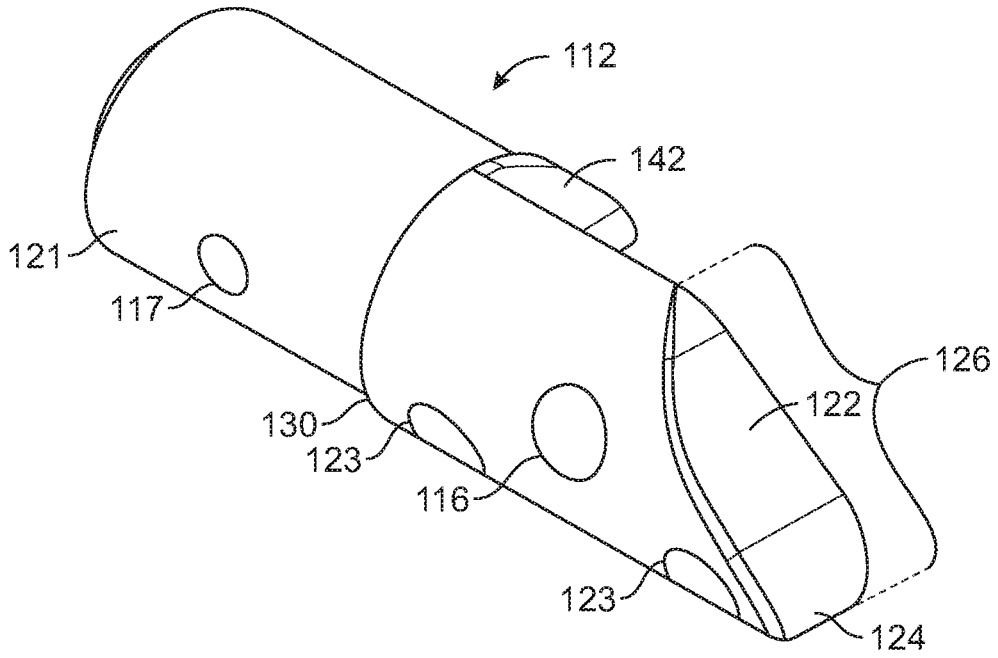

As shown in FIGS. 15-17, hinge assembly 110 comprises a first hinge body 112 and a matingly engaged second hinge body 114. The first and second hinge body 112, 114 have identical construction. For ease of explanation, FIGS. 16 and 17 will refer to the first hinge body 112. First hinge body 112 includes a pivot hole 116 configured to accept a cylindrical object 118 such as, a pivot pin, pivot bolt, or pivot screw and the like. The cylindrical body 118 allows for free rotation of the first hinge body 112 and second hinge body 114 relative to each other. As best shown in FIG. 17, the forward end 120 of the first pivot body 112 includes an inclined surface 122 which intersects with an arcuate surface 124, such that both surfaces 122 and 124 collectively define a locking surface 126. The incline surface 122 in one construction may have an incline angle when measured from the horizontal of 37.50 degrees. Nevertheless, other ranges of the incline angle are possible within the teaching of the present disclosure. The rear end portion 121 of first hinge body 112 has a diameter sized to be inserted into the interior diameter of the tube frame 18 (not shown in FIG. 17). Nevertheless, the rear end portion 121 can be sized larger than the outer diameter of the tube 18 to function as a sleeve. A fastening thru-hole 117 is disposed on the rear end portion 121 so that a fastening member, such as bolt or screw, can be secured the first hinge body 112 to the tube 18 via a matching hole in the tube. A flange 130 is provided on the first hinge body 112 so that the hinge body 112 is disposed at sufficient length inside of the tube 18 for strength and stability of the hinge assembly 110.

Figure 18:
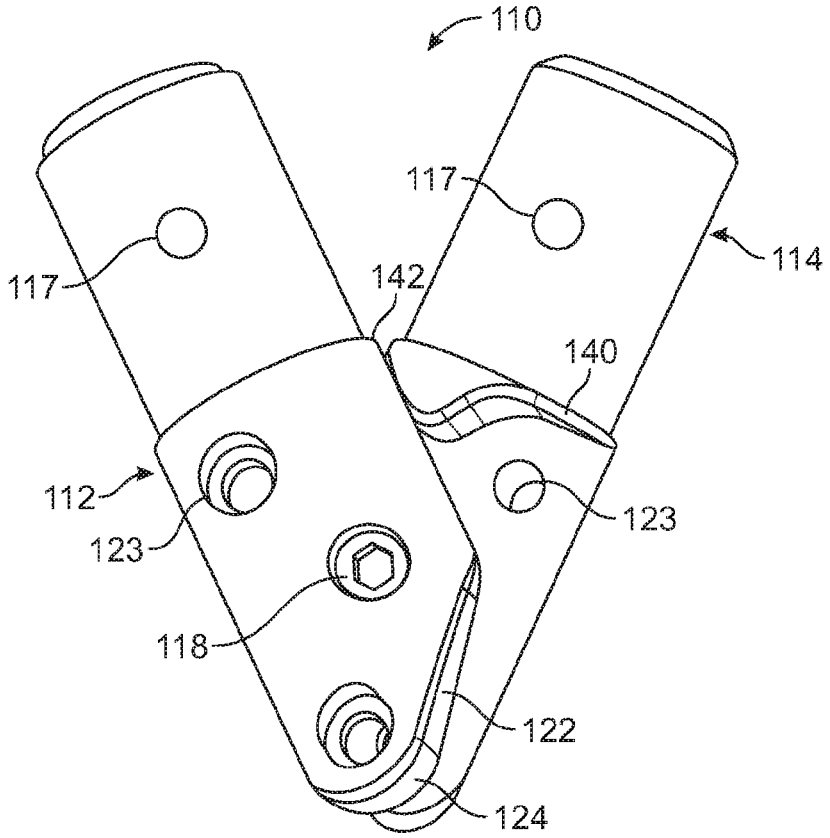
FIG. 18 is an enlarged view of the hinge assembly in a folded pivotal position operation.
Figure 19:
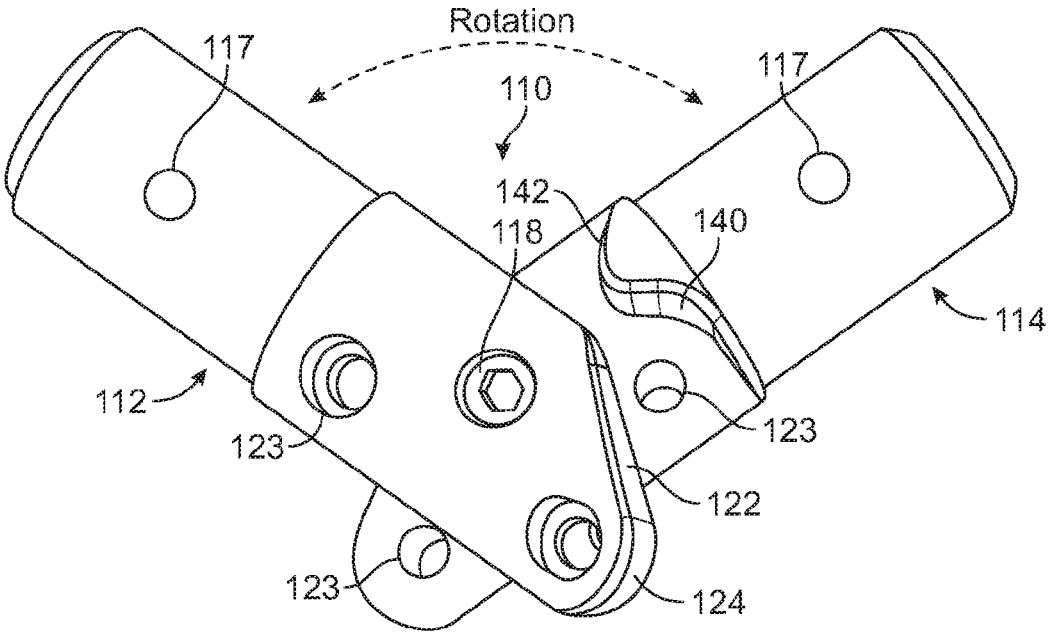
FIG. 19 is an enlarged view of the hinge assembly in an intermediate pivotal position operation.
Figure 20:
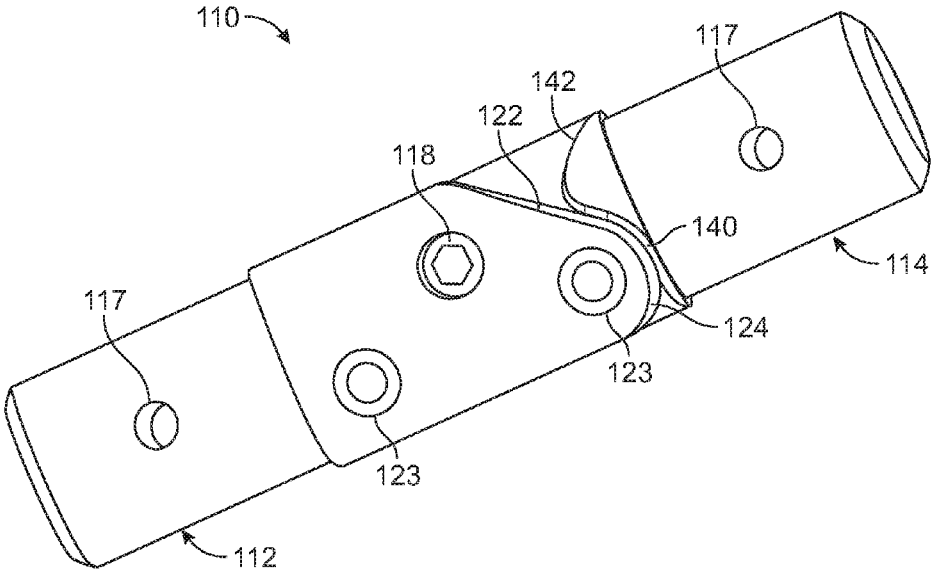
FIG. 20 is an enlarged view of the hinge assembly in a locked pivotal position operation.

Referring to FIG. 16, first hinge body 112 includes a curvilinear surface 140 configured to match and matingly engage the curvature of surface 124. Referring to FIGS. 18-19, the operation of the hinge assembly 110 provides for a smooth and stable transition from the folded state shown in FIG. 18 to the intermediate state shown in FIG. 19 to the final locked state shown in FIG. 20. It is noted in the folded position shown in FIG. 19, resting surface 142 enables hinge body 112 to rest upon hinge body 114. In operation, locking surface 126 mates and abuts curvilinear surface 140 to provide a sufficiently strong and structural connection. The hinge assembly 110 in the offset configuration provides a mechanical advantage to pull the frame 12 tubes 18 into position and keeps the tubes parallel for the locked state. However, embodiments are not limited to the specific surfaces described herein and may be composed of other surface configurations to comprise the hinge assembly that fall within the spirit and scope of the principles of this disclosure.

To complete the locked state, a locking device 119, such as a cylindrical removable fastener, bolt, or screw, are fastened in to the thru-holes 123. It should be noted that thru-holes 117, 116, 123 may have an interior mechanical thread in the bore configured to receive the threads of bolts 118 and 119. In an alternative construction, in lieu of removable bolts 119 to complete the locking function, a push-button/pin arrangement could be provided within the scope of the disclosure. In such an arrangement, the push-button could be a linearly moveable pin disposed in through holes 123 of hinge body 112, 114. In an alternative construction, the bolts 119 could be retained in one of the hinge bodies, such as body 112. Then, to complete locking function, the bolts 119 may be rotated into the threads of the corresponding through holes 123 of hinge body 114.

Figure 21:
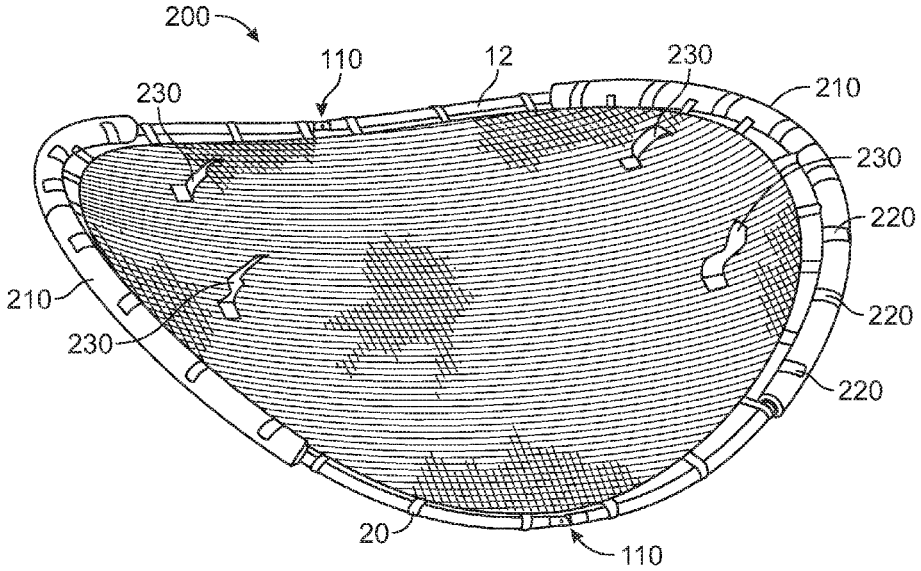
FIG. 21 illustrates an alternative construction of an amusement device according to the teachings of the present disclosure.
Figure 22:
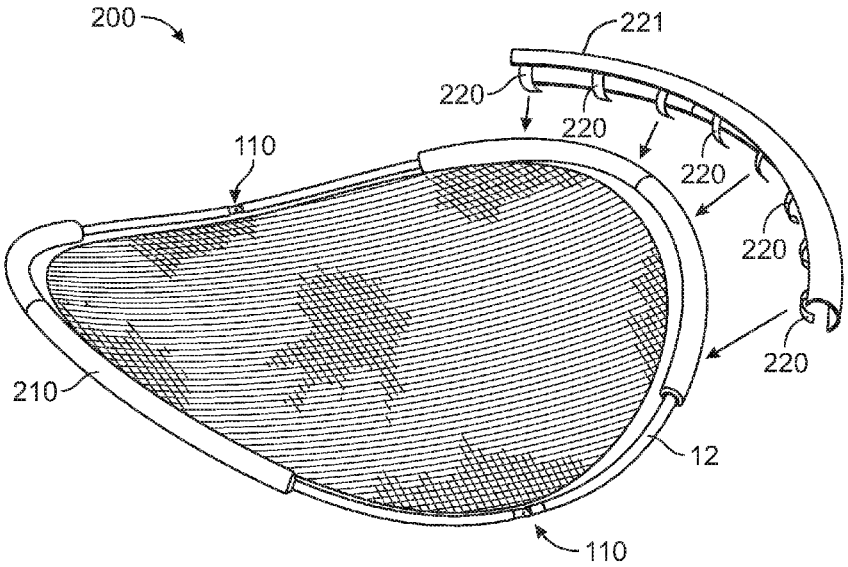
FIG. 22 illustrates a partial exploded assembly view the amusement device of FIG. 21 according to the teachings of the present disclosure

FIGS. 21 and 22 illustrate an alternative construction of an amusement device 200 according to the teachings of the present disclosure. The alternative rocking amusement device 200 is similar to the construction of rocking amusement device 11 and 100, except that amusement device 200 includes a removably attached tubular resilient bumper 210 which mounts on frame 12. Bumper 210 has a plurality of strap closure members 220 having a hook and loop closure arrangement. The hook and look closure arrangement is commonly known as Velcro®. Nevertheless, other closure mechanisms can be used in the present design. The bumper 210 may be constructed of a fabric covering and resilient foam, such as a polymer foam material, such as polyurethane and the like.

Figure 12:
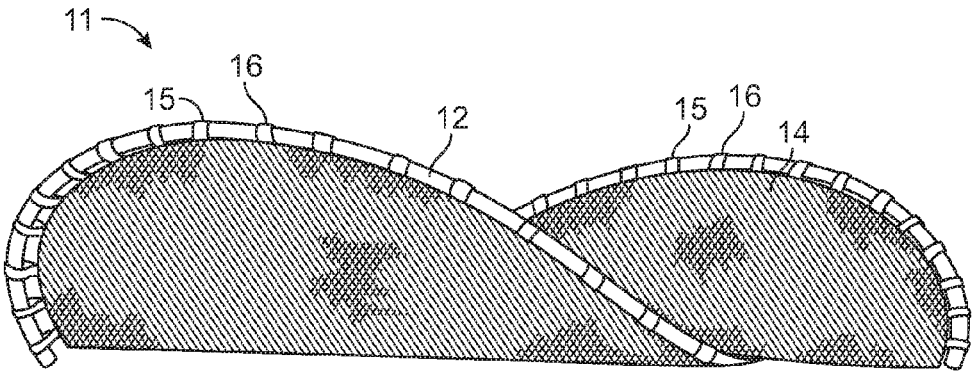
FIG. 12 illustrates one in-use function of the amusement device as a play shelter.

Aspects of the disclosure have been described in terms of illustrative embodiments thereof. Additionally, the devices 11, 100, 200 could be used as a shelter to shield users from weather elements, such as rain or snow or a sun blocking function (UVA and UVB wavelength blocking). (See FIG. 12) Numerous other embodiments, modifications, and variations within the scope and spirit of the appended claims will occur to persons of ordinary skill in the art from a review of this disclosure. For example, one or more of the steps depicted in the illustrative figures may be performed in other than the recited order, and one or more depicted steps may be optional in accordance with aspects of the disclosure.

What is claimed is:

1. An amusement device, comprising:

a hyperbole paraboloid frame structure defining an interior area and the frame structure being pivotally attached with a plurality of hinge assemblies; and a resilient support member disposed in the interior area of the frame structure and attached to the frame structure;

wherein each hinge assembly having an interlocking first hinge body and a second hinge body having a longitudinal axis, wherein the first hinge body and the second hinge body are pivotable about a traverse axis to said longitudinal axis; each of the first hinge body and the second hinge body having a proximal curvilinear surface intersecting a linear surface, and a distal inclined linear surface intersecting an arcuate surface; each of the first hinge body and the second hinge body having at least one aperture, and the at least one apertures being adapted to be aligned together collectively defining a locking aperture configured to accept a removable locking device therein that extends into the first hinge body and the second hinge body;

wherein a locked state is defined when the locking device is engaged in the locking aperture, and the proximal curvilinear surface and linear surface being matingly engaged with the distal arcuate surface and the inclined linear surface, respectively, so as to prevent rotation of the first hinge body and second hinge body about said traverse axis.

2. The amusement device according to claim 1, further comprising each of the first hinge body and the second hinge body having two apertures, respectively, and the apertures of the first hinge body and second hinge body being adapted to be aligned together collectively defining two locking apertures each locking aperture being configured to accept locking device therein that extends into the first hinge body and the second hinge body wherein a locked state is defined when the locking devices are engaged in the locking apertures, and the proximal curvilinear surface and linear surface being interlocked with the distal arcuate surface and the inclined linear surface, respectively, so as to prevent rotation of the first hinge body and second hinge body about said traverse axis.

3. The amusement device according to claim 1, wherein the hyperbole paraboloid frame structure comprises a plurality of interlocking curved tubes.

4. The amusement device according to claim 1, wherein the hyperbole paraboloid frame structure further comprises at least one handle.

5. The amusement device according to claim 1, further comprising a removably attached resilient tubular bumper adapted for mounting to the hyperbole paraboloid frame structure.

6. The amusement device according to claim 5, wherein the bumper includes a plurality of removably attached closure members to mount to the hyperbole paraboloid frame structure.

7. The amusement device according to claim 1, further comprising a plurality of resilient and non-resilient sleeves configured to attach the support member to the hyperbole paraboloid frame structure.

8. The amusement device according to claim 7, wherein the circumference of the support member includes an alternating pattern of resilient material sleeves and non-resilient material sleeves.

9. The amusement device according to claim 7, wherein the sleeves include a phosphorescent material applied thereon.

10. The amusement device according to claim 1, wherein the support member includes a phosphorescent material at an edge.

11. The amusement device according to claim 1, further comprising a plurality of sleeves configured to attach the support member to the hyperbole paraboloid frame structure.

12. The amusement device according to claim 11, wherein the sleeves includes a phosphorescent material.

13. An amusement device, comprising:

a hyperbole paraboloid frame structure having a plurality of portions being pivotally attached together;

a resilient support member disposed in an interior area of the frame structure and attached to the frame structure; and a plurality of sleeves configured to attach the support member to the frame structure;

wherein the portions includes a plurality of pivotal hinge assemblies, each hinge assembly having an interlocking first hinge body and a second hinge body having a longitudinal axis, wherein the first hinge body and the second hinge body are pivotable about a traverse axis to said longitudinal axis; each of the first hinge body and the second hinge body having a proximal end and a distal end, the proximal end having a curvilinear surface connected to a linear surface, and the distal end having an arcuate surface connected to an inclined linear surface; each of the first hinge body and the second hinge body having at least one aperture, and the at least one apertures being adapted to be aligned together collectively defining a locking aperture configured to accept a linear movably locking device therein that extends into the first hinge body and the second hinge body;

wherein a locked state is defined when the locking device is engaged in the locking aperture, and the proximal curvilinear surface and linear surface being interlocked with the distal arcuate surface and the inclined linear surface, respectively, so as to prevent rotation of the first hinge body and second hinge body about said traverse axis.

14. The amusement device according to claim 13, wherein the locking device is removably attached to at least one of the first hinge body and the second hinge body.

15. The amusement device according to claim 13, further comprising a removably attached resilient tubular bumper adapted for mounting to the hyperbole paraboloid frame structure.

16. The amusement device according to claim 13, wherein the plurality of sleeves further comprises a plurality an alternating pattern of resilient material sleeves and non-resilient material sleeves.

17. An amusement device, comprising:

a hyperbole paraboloid frame structure having at least two portions being pivotally attached together by a plurality of pivotal hinge assemblies;

a resilient support member disposed in an interior area of the frame structure and attached to the frame structure by a plurality of sleeves;

wherein each hinge assembly includes an interlocking first hinge body and a second hinge body having a longitudinal axis, wherein the first hinge body and second hinge body are adapted to pivot about a traverse axis to said longitudinal axis; each of the first hinge body and the second hinge body having a proximal end and an opposing a distal end, the proximal end having a curvilinear surface intersecting a linear surface, and the distal end having an arcuate surface intersecting an inclined linear surface; each of the first hinge body and the second hinge body having at least one aperture, and the at least one apertures being adapted to be aligned together collectively defining a locking aperture configured to accept a locking device therein that extends into the first hinge body and the second hinge body;

wherein a locked state is defined when the locking device is engaged in the locking aperture, and the proximal curvilinear surface and linear surface being matingly interlocked with the distal arcuate surface and the inclined linear surface, respectively, so as to prevent rotation of the first hinge body and second hinge body about said traverse axis.

18. The amusement device according to claim 17, wherein each of the first hinge body and the second hinge body having two apertures, respectively, and the apertures of the first hinge body and second hinge body being adapted to be aligned together collectively defining two locking apertures each locking aperture being configured to accept locking device therein that extends into the first hinge body and the second hinge body wherein a locked state is defined when the locking devices are engaged in the locking apertures, and the proximal curvilinear surface and linear surface being interlocked with the distal arcuate surface and the inclined linear surface, respectively, so as to prevent rotation of the first hinge body and second hinge body about said traverse axis.

19. The amusement device according to claim 17, wherein the plurality of sleeves further comprises a plurality of resilient and non-resilient sleeves configured to attach the support member to the hyperbole paraboloid frame structure.

20. The amusement device according to claim 17, wherein the hyperbole paraboloid frame structure further comprises at least one handle.

* * * * *